US007186193B1

(12) United States Patent
McFadden, Jr.

(10) Patent No.: US 7,186,193 B1
(45) Date of Patent: Mar. 6, 2007

(54) EXERCISE TRAINING APPARATUS FOR TENNIS PLAYERS

(76) Inventor: James Monroe McFadden, Jr., 2014 Reflective Water Rd., Villa Rico, GA (US) 30180

( * ) Notice: Subject to any disclaimer, the term of this patent is extended or adjusted under 35 U.S.C. 154(b) by 0 days.

(21) Appl. No.: 11/339,114

(22) Filed: Jan. 26, 2006

(51) Int. Cl.
*A63B 69/38* (2006.01)

(52) U.S. Cl. ..... 473/459

(58) Field of Classification Search ..... 473/459, 473/473, 474, 462
See application file for complete search history.

(56) References Cited

U.S. PATENT DOCUMENTS

| | | | | |
|---|---|---|---|---|
| 3,262,703 | A * | 7/1966 | Hodlick | 473/474 |
| 3,893,669 | A * | 7/1975 | Myers | 473/418 |
| 3,897,057 | A * | 7/1975 | Pennington | 473/427 |
| 4,021,036 | A * | 5/1977 | Nelson et al. | 473/459 |
| 4,023,798 | A | 5/1977 | Pronin | |
| 4,049,266 | A | 9/1977 | Feiler | |
| 4,141,550 | A | 2/1979 | Denizman | |
| 4,160,549 | A | 7/1979 | Simpson | |
| 4,162,070 | A * | 7/1979 | Georges | 473/462 |
| 4,191,372 | A * | 3/1980 | Keller | 473/418 |
| 4,269,410 | A * | 5/1981 | Martin | 473/418 |
| 4,502,685 | A | 3/1985 | Phillips et al. | |
| 4,948,150 | A * | 8/1990 | Daly et al. | 473/430 |
| 5,011,143 | A | 4/1991 | Jones | |
| 5,755,631 | A * | 5/1998 | Paschka | 473/459 |
| 5,913,739 | A * | 6/1999 | Brenneisen | 473/430 |
| 6,334,821 | B1 * | 1/2002 | Kita | 473/430 |
| 6,648,780 | B1 * | 11/2003 | Boldin | 473/461 |
| 6,672,979 | B2 * | 1/2004 | Brenneisen | 473/430 |
| 6,729,978 | B2 * | 5/2004 | Moss et al. | 473/430 |
| 6,790,150 | B1 * | 9/2004 | Moss et al. | 473/430 |
| 7,115,051 | B2 * | 10/2006 | Hansberry | 473/423 |
| 7,115,052 | B2 * | 10/2006 | Wardle et al. | 473/459 |
| 2001/0003106 | A1 * | 6/2001 | Brenneisen | 473/430 |
| 2003/0064836 | A1 * | 4/2003 | Moss et al. | 473/417 |
| 2003/0224880 | A1 * | 12/2003 | Hansberry | 473/430 |
| 2004/0176191 | A1 * | 9/2004 | Moss et al. | 473/430 |
| 2005/0113193 | A1 * | 5/2005 | Wardle et al. | 473/459 |
| 2005/0288127 | A1 * | 12/2005 | Moss et al. | 473/430 |

* cited by examiner

*Primary Examiner*—Raleigh W. Chiu

(57) ABSTRACT

A tennis ball holding apparatus includes a central tubular shaft that has a bore formed therein and has apertures formed along a length thereof. A base has legs radially extending outward from a central shaft bottom end and is monolithically formed with the central shaft. A non-linear boom is spaced above the central shaft and has an eyelet mated to a proximal end thereof. The proximal end of the non-linear boom is linearly offset from a distal end thereof. A support bracket has a bottom arm telescopically engaged with the central shaft and includes a tubular top sleeve that is adjustably connected to the linear bottom arm. A mechanism is included for automatically returning the boom to an equilibrium height. A cord is tethered to the eyelet, includes a fastener attached to a bottom end thereof for holding a tennis ball, and is spaced proximal to the automatic returning mechanism.

18 Claims, 4 Drawing Sheets

EXERCISE TRAINING APPARATUS FOR TENNIS PLAYERS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to training apparatuses and, more particularly, to an exercise training apparatus for tennis players.

2. Prior Art

The serve is one of the most important aspects of the game of tennis. While a good serve requires proper body positioning and movement, proper toss of the ball is also critical to an effective serve. A serve must be consistent and thus consistency in each of the elements necessary to a proper serve is critical. A player must be able to repeat with consistency proper body positioning and movement, grip of the tennis racket, as well as the toss of the ball.

Hitherto, the tennis serve has been practiced by merely serving a large number of balls on a court. The drawback to such a training method is that the player is not encouraged to correct any defect in his/her serving action which should be to reach upward and outward to strike the ball. Furthermore, practicing ball placement for the serve is made difficult because there is no reference point against which to gauge the height and position of the ball in the air in relation to where the player's feet are placed.

Accordingly, a need remains for an exercise training apparatus for tennis players in order to overcome the above-noted shortcomings. The present invention satisfies such a need by providing a tennis serve training apparatus that is easy and convenient to use, durable in design, adjustable in height, and is easily transportable. Such a training apparatus allows a tennis player to repeatedly practice their serve at virtually any location, whether it is indoors or outdoors. The height adjustable nature of the apparatus also advantageously allows persons of varying heights to use to same apparatus with a quick and simple adjustment.

BRIEF SUMMARY OF THE INVENTION

In view of the foregoing background, it is therefore an object of the present invention to provide an exercise training apparatus for tennis players. These and other objects, features, and advantages of the invention are provided by a portable tennis ball holding apparatus for assisting a tennis player to practice and improve their tennis swing in a confined area.

The portable tennis ball holding apparatus includes a central tubular shaft that has an axial bore formed therein that extends along an entire longitudinal length of the central shaft. Such a shaft has a plurality of equidistantly spaced apertures formed along a linear path traveling parallel to the longitudinal length.

A base has a plurality of coextensively shaped legs equidistantly spaced apart and radially extending outward from a bottom end of the central shaft. Such a base is monolithically formed with the central shaft such that the central shaft and the base can advantageously and effectively be readily transported as a single unit.

An elongated and non-linear boom is spaced above the central shaft. Such a non-linear boom has an eyelet directly mated to a proximal end of the non-linear boom. The proximal end of the non-linear boom is linearly offset from a distal end of the non-linear boom in such a manner that the proximal end of the non-linear boom is oriented along a horizontal plane when the distal end of the non-linear boom is disposed along an inclined plane. Such a non-linear boom is preferably slidably interfitted through the top sleeve such that the proximal end of the non-linear boom protrudes outwardly and beyond the base for providing a sufficient area to swing a racket without contacting the central shaft.

A support bracket has a linear bottom arm telescopically engaged directly with the central shaft so that the linear bottom arm is slidably positional along a vertical path registered parallel to the longitudinal length of the central shaft. Such a support bracket further includes a hollow tubular top sleeve that is adjustably connected directly to the linear bottom arm. The non-linear boom and the top sleeve may be resiliently rotatable about the linear bottom arm of the support bracket such that a positioned of the proximal end is conveniently adjustable between varying heights.

A mechanism is included for automatically returning the non-linear boom to an equilibrium height after the non-linear boom is biased to a non-equilibrium height. Such an automatic returning mechanism preferably includes a helical spring member that is resiliently adaptable between expanded and retracted positions defined along an arcuate path offset from a vertical axis and a horizontal axis respectively. A pair of eyelets are directly conjoined to a distal end of the non-linear boom and a top end of the central shaft. The helical spring member has opposed ends directly coupled to the eyelets respectively. Such a helical spring member is oppositely situated from the tethered cord for effectively providing adequate torque during rebound.

A cord is tethered to the eyelet of the non-linear boom. Such a cord includes a fastener attached to a bottom end thereof for temporarily holding a tennis ball at a predetermined height above a ground surface. The fastener preferably includes a hook and loop fastener. The tethered cord is spaced proximal to the automatic returning mechanism.

The apparatus preferably further includes a latch pivotally connected to the non-linear boom. Such a latch has a hooked bottom lip for effectively allowing a user to quickly and manually pivot the non-linear boom to a lowered position when attached a new tennis ball to the fastener of the tethered cord.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
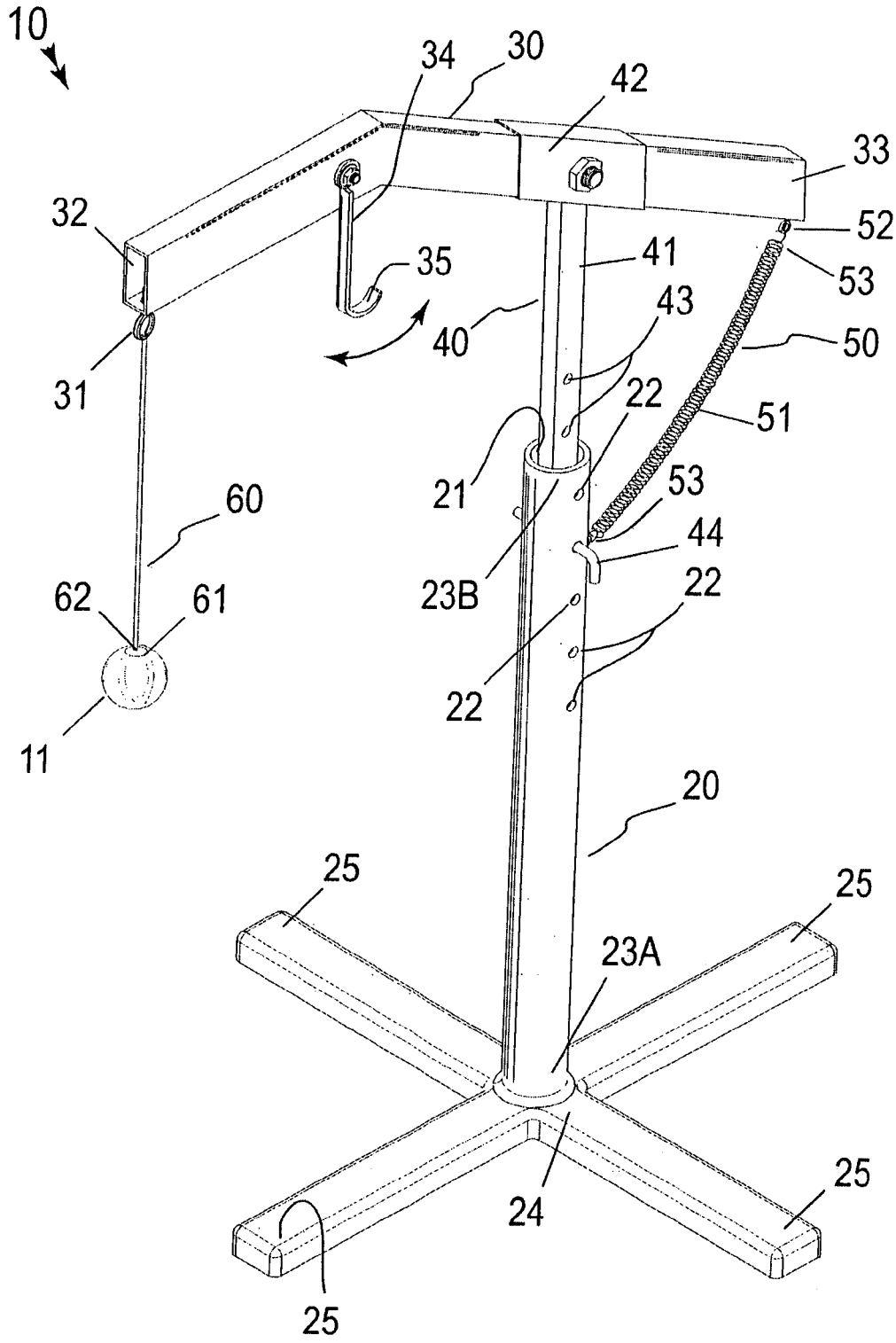
FIG. 1 is a perspective view showing an exercise training apparatus for tennis players, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide an exercise training apparatus for tennis players. It should be understood that the apparatus 10 may be used for exercising and training of many different types of athletes and should not be limited in use to only tennis players.

Referring initially to FIGS. 1 through 4, the apparatus 10 includes a central tubular shaft 20 that has an axial bore 21 formed therein that extends along an entire longitudinal length of the central shaft 20. Such a shaft 20 has a plurality of equidistantly spaced apertures 22 formed along a linear path traveling parallel to the longitudinal length. Of course, the number of apertures 22 and the respective distance between adjacent apertures 22 may be altered for effectively allowing the apparatus 10 to be adjusted to different heights, as is obvious to a person of ordinary skill in the art.

Still referring to FIGS. 1 through 4, a base 24 has a plurality of coextensively shaped legs 25 equidistantly spaced apart and radially extending outward from a bottom end 23A of the central shaft 20. Such a base 24 is monolithically formed with the central shaft 20, which is essential and advantageous such that the central shaft 20 and the base 24 can conveniently and effectively be readily transported as a single unit.

Again referring to FIGS. 1 through 4, an elongated and non-linear boom 30 is spaced above the central shaft 20. Such a non-linear boom 30 has an eyelet 31 directly mated, without the use of intervening elements, to a proximal end 32 of the non-linear boom 30. The proximal end 32 of the non-linear boom 30 is linearly offset from a distal end 33 of the non-linear boom 30 in such a manner that the proximal end 32 of the non-linear boom 30 is oriented along a horizontal plane when the distal end 33 of the non-linear boom 30 is disposed along an inclined plane.

Such a non-linear boom 30 is slidably interfitted through the top sleeve 42 (described herein below), which is important such that the proximal end 32 of the non-linear boom 30 protrudes outwardly and beyond the base 24. This is a crucial and advantageous feature for providing a sufficient area to swing a racket without contacting the central shaft 20. Also, it is essential to the proper function of the present invention for the non-linear boom 30 to offset downwardly from the distal end such that the proximal end 32 lays horizontal to hold a tennis ball 11 at equilibrium during practicing conditions. Otherwise, the tennis ball 11 will not line up perpendicularly from the boom 30.

Yet again referring to FIGS. 1 through 4, a support bracket 40 has a linear bottom arm 41 telescopically engaged directly, without the use of intervening elements, with the central shaft 20 so that the linear bottom arm 41 is slidably positional along a vertical path registered parallel to the longitudinal length of the central shaft 20. Such a support bracket 40 further includes a hollow tubular top sleeve 42 that is adjustably connected directly, without the use of intervening elements, to the linear bottom arm 41. The non-linear boom 30 and the top sleeve 42 are resiliently rotatable about the linear bottom arm 41 of the support bracket 40, which is important such that a position of the proximal end 32 is conveniently adjustable between varying heights. This is a vital feature of the apparatus 10 for allowing persons of varying heights to use the same apparatus 10 by quickly and easily altering the height of the proximal end 32. The linear bottom arm 41 further includes a plurality of equidistantly spaced apertures 43 formed therethrough that are horizontally aligned with the central shaft apertures 22. A quick release pin 44 is horizontally displaced through the shaft apertures 22 and the bottom arm apertures 43 respectively, which is vital for fixedly adjusting the apparatus 10 to a desired height.

Figure 3:
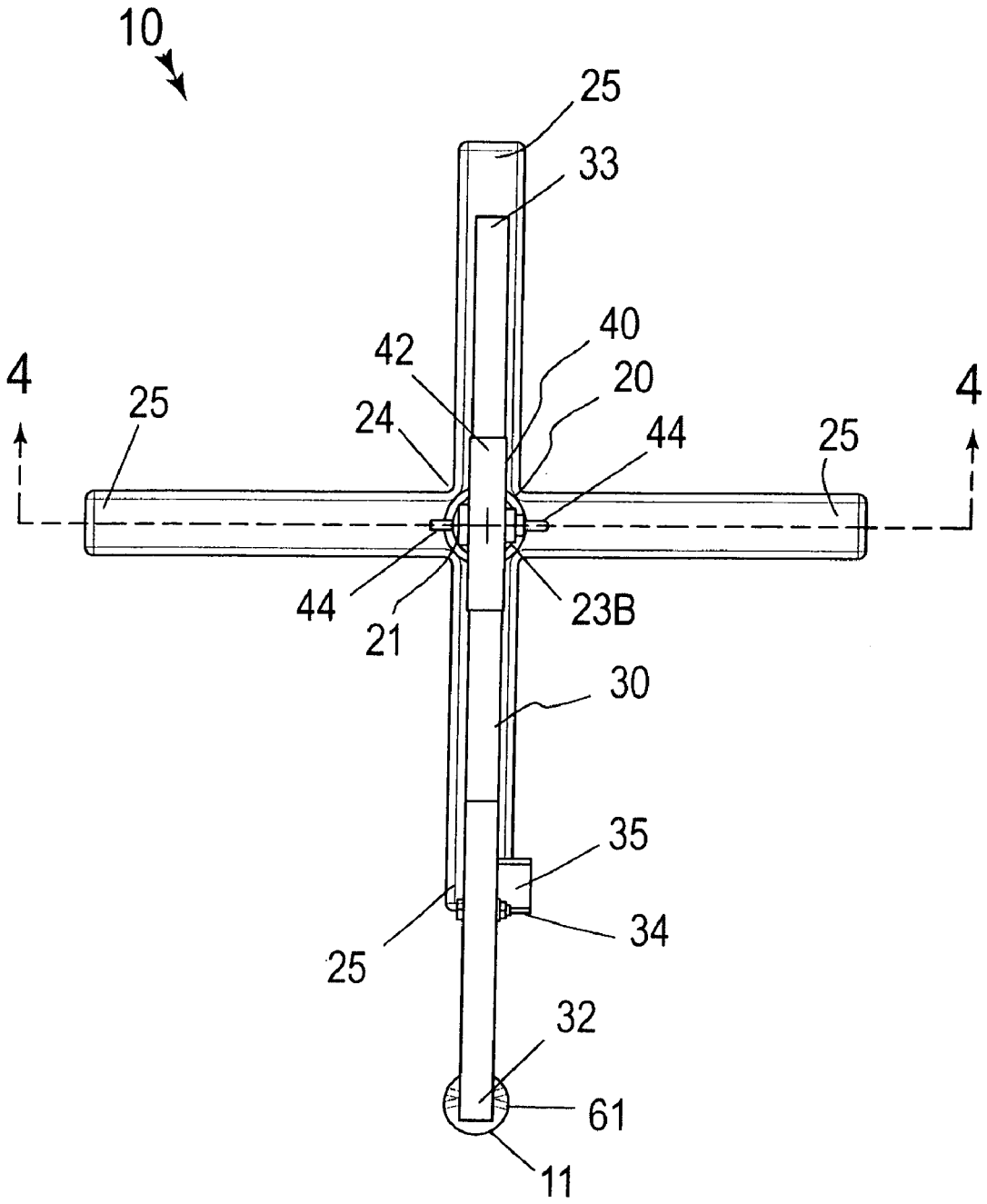
FIG. 3 is a top plan view of the apparatus shown in FIG. 1.
Figure 4:
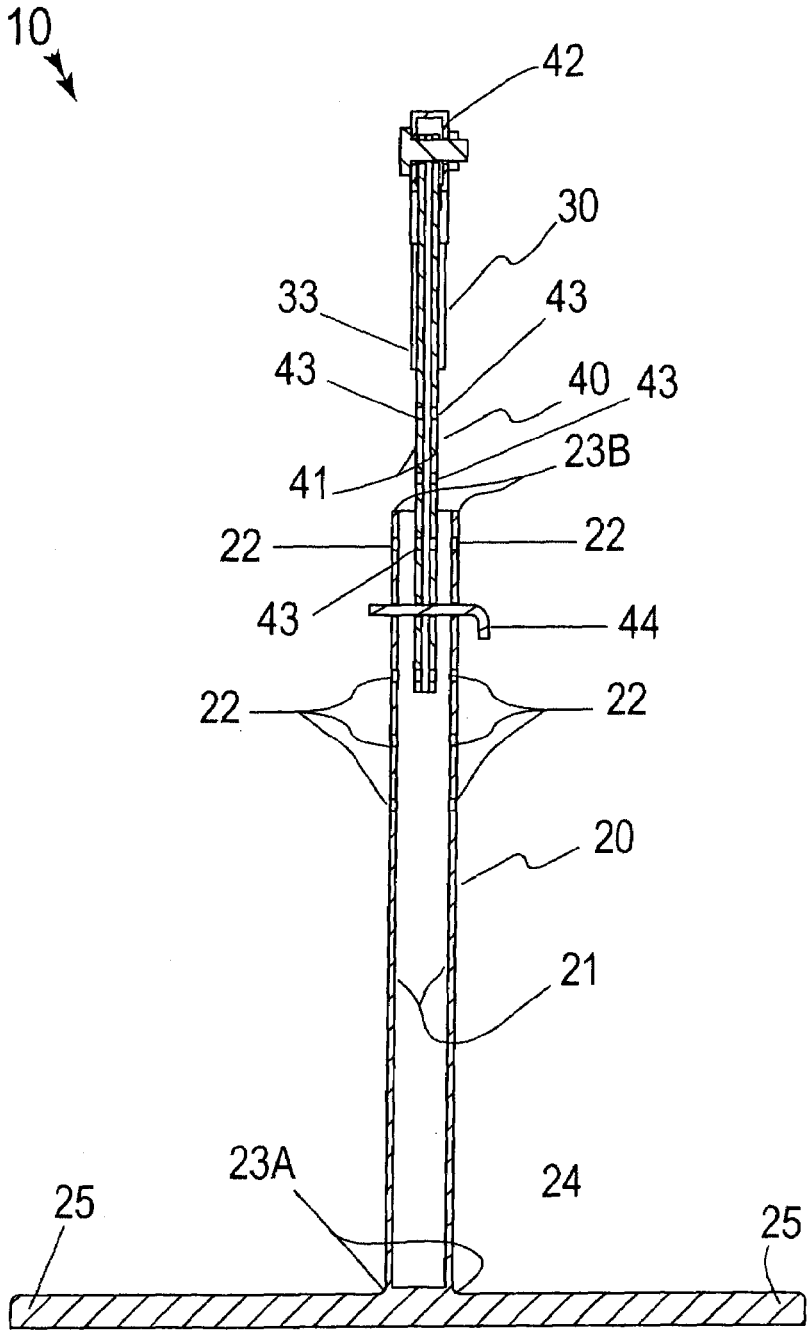
FIG. 4 is a cross-sectional view of the apparatus shown in FIG. 3, taken along line 4—4.

Referring to FIGS. 1 and 3, a mechanism 50 is included for automatically returning the non-linear boom 30 to an equilibrium height after the non-linear boom 30 is biased to a non-equilibrium height. Such an automatic returning mechanism 50 includes a helical spring member 51 that is resiliently adaptable between expanded and retracted positions defined along an arcuate path offset from a vertical axis and a horizontal axis respectively. A pair of eyelets 52 are directly conjoined, without the use of intervening elements, to a distal end 33 of the non-linear boom 30 and a top end 23B of the central shaft 20. The helical spring member 51 has opposed ends 53 directly coupled, without the use of intervening elements, to the eyelets 52 respectively. Such a helical spring member 51 is oppositely situated from the tethered cord 60 (described herein below) for effectively providing adequate torque during rebound.

Figure 2:
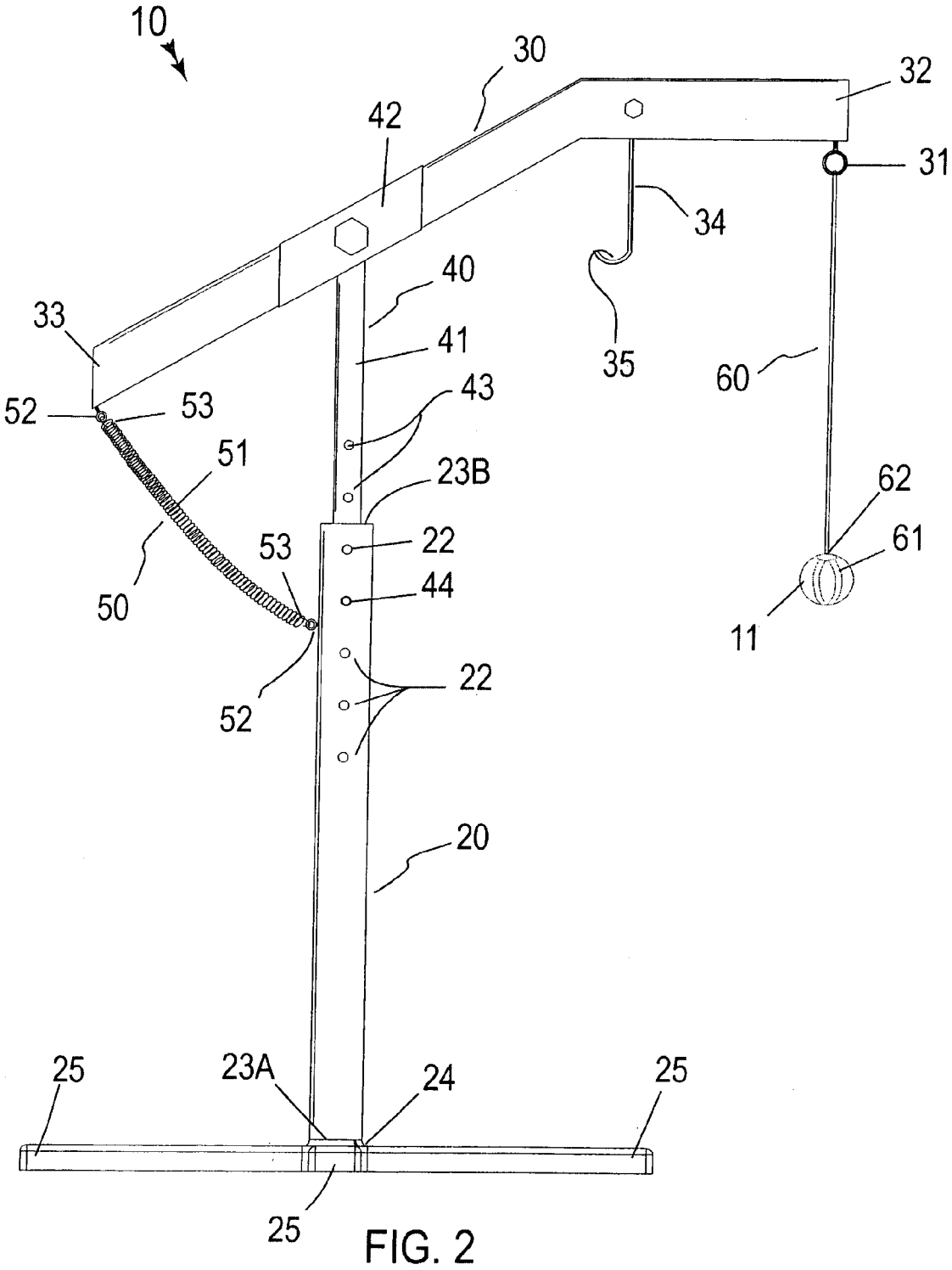
FIG. 2 is a rear-elevational view of the apparatus shown in FIG. 1.

Referring to FIGS. 1, 2 and 3, a cord 60 is tethered to the eyelet 31 of the non-linear boom 30. Such a cord 60 includes a fastener 61 attached to a bottom end 62 thereof that is critical for temporarily holding a tennis ball 11 at a predetermined height above a ground surface. Of course, the apparatus 10 may be provided with a plurality of cords 60 having alternate lengths for allowing a user to practice their serve, forward and backswing respectively, as is obvious to a person of ordinary skill in the art. The fastener 61 includes a hook and loop fastener. The tethered cord 60 is spaced proximal to the automatic returning mechanism 50. Such a tethered cord 60 is important for ensuring that the tennis ball 11 is not propelled beyond a length of the cord 60, thus advantageously allowing an athlete to practice their tennis serve, and forward and backwards swing at both indoor and outdoor locations.

Again referring to FIGS. 1, 2 and 3, the apparatus 10 further includes a latch 34 pivotally connected to the non-linear boom 30. Such a latch 34 has a hooked bottom lip 35 that is vital for effectively allowing a user to quickly and manually pivot the non-linear boom 30 to a lowered position when attaching a new tennis ball 11 to the fastener 61 of the tethered cord 60. This feature saves the user a considerable amount of time and energy that would otherwise be spent in lowering the apparatus 10 to attach the tennis ball 11, and re-raising the apparatus 10 to its original height after attaching the tennis ball 11.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable tennis ball holding apparatus for assisting a tennis player to practice and improve their tennis swing in a confined area, said portable tennis ball holding apparatus comprising:

a central tubular shaft having an axial bore formed therein and extending along an entire longitudinal length of said central shaft, said shaft having a plurality of equidistantly spaced apertures formed along a linear path traveling parallel to the longitudinal length;

a base having a plurality of coextensively shaped legs equidistantly spaced apart and radially extending outward from a bottom end of said central shaft, said base being monolithically formed with said central shaft such that said central shaft and said base can be readily transported as a single unit;

an elongated and non-linear boom spaced above said central shaft, said non-linear boom having an eyelet directly mated to a proximal end of said non-linear boom;

a support bracket having a linear bottom arm telescopically engaged directly with said central shaft such that linear bottom arm is slidably positional along a vertical path registered parallel to the longitudinal length of said central shaft, said support bracket further including a hollow tubular top sleeve adjustably connected directly to said linear bottom arm;

means for automatically returning said non-linear boom to an equilibrium height after said non-linear boom is biased to a non-equilibrium height; and a cord tethered to said eyelet of said non-linear boom, said cord including a fastener attached to a bottom end thereof for temporarily holding a tennis ball at a predetermined height above a ground surface.

2. The apparatus of claim 1, wherein said non-linear boom is slidably interfitted through said top sleeve such that said proximal end of said non-linear boom protrudes outwardly and beyond said base for providing a sufficient area to swing a racket without contacting said central shaft.

3. The apparatus of claim 1, wherein said non-linear boom and said top sleeve are resiliently rotatable about said linear bottom arm of said support bracket such that a positioned of said proximal end is adjustable between varying heights.

4. The apparatus of claim 1, further comprising: a latch pivotally connected to said non-linear boom, said latch having a hooked bottom lip for allowing a user to quickly and manually pivot said non-linear boom to a lowered position when attached a new tennis ball to said fastener of said tethered cord.

5. The apparatus of claim 1, wherein said automatic returning means comprises:

a helical spring member resiliently adaptable between expanded and retracted positions defined along an arcuate path offset from a vertical axis and a horizontal axis respectively; and a pair of eyelets directly conjoined to a distal end of said non-linear boom and a top end of said central shaft;

wherein said helical spring member has opposed ends directly coupled to said eyelets respectively, said helical spring member being oppositely situated from said tethered cord for providing adequate torque during rebound.

6. The apparatus of claim 1, wherein said fastener comprises: a hook and loop fastener.

7. A portable tennis ball holding apparatus for assisting a tennis player to practice and improve their tennis swing in a confined area, said portable tennis ball holding apparatus comprising:

a central tubular shaft having an axial bore formed therein and extending along an entire longitudinal length of said central shaft, said shaft having a plurality of equidistantly spaced apertures formed along a linear path traveling parallel to the longitudinal length;

a base having a plurality of coextensively shaped legs equidistantly spaced apart and radially extending outward from a bottom end of said central shaft, said base being monolithically formed with said central shaft such that said central shaft and said base can be readily transported as a single unit;

an elongated and non-linear boom spaced above said central shaft, said non-linear boom having an eyelet directly mated to a proximal end of said non-linear boom, wherein said proximal end of said non-linear boom is linearly offset from a distal end of said non-linear boom in such a manner that said proximal end of said non-linear boom is oriented along a horizontal plane when said distal end of said non-linear boom is disposed along an inclined plane;

a support bracket having a linear bottom arm telescopically engaged directly with said central shaft such that linear bottom arm is slidably positional along a vertical path registered parallel to the longitudinal length of said central shaft, said support bracket further including a hollow tubular top sleeve adjustably connected directly to said linear bottom arm;

means for automatically returning said non-linear boom to an equilibrium height after said non-linear boom is biased to a non-equilibrium height; and a cord tethered to said eyelet of said non-linear boom, said cord including a fastener attached to a bottom end thereof for temporarily holding a tennis ball at a predetermined height above a ground surface.

8. The apparatus of claim 7, wherein said non-linear boom is slidably interfitted through said top sleeve such that said proximal end of said non-linear boom protrudes outwardly and beyond said base for providing a sufficient area to swing a racket without contacting said central shaft.

9. The apparatus of claim 7, wherein said non-linear boom and said top sleeve are resiliently rotatable about said linear bottom arm of said support bracket such that a positioned of said proximal end is adjustable between varying heights.

10. The apparatus of claim 7, further comprising: a latch pivotally connected to said non-linear boom, said latch having a hooked bottom lip for allowing a user to quickly and manually pivot said non-linear boom to a lowered position when attached a new tennis ball to said fastener of said tethered cord.

11. The apparatus of claim 7, wherein said automatic returning means comprises:

a helical spring member resiliently adaptable between expanded and retracted positions defined along an arcuate path offset from a vertical axis and a horizontal axis respectively; and a pair of eyelets directly conjoined to a distal end of said non-linear boom and a top end of said central shaft;

wherein said helical spring member has opposed ends directly coupled to said eyelets respectively, said helical spring member being oppositely situated from said tethered cord for providing adequate torque during rebound.

12. The apparatus of claim 7, wherein said fastener comprises: a hook and loop fastener.

13. A portable tennis ball holding apparatus for assisting a tennis player to practice and improve their tennis swing in a confined area, said portable tennis ball holding apparatus comprising:

a central tubular shaft having an axial bore formed therein and extending along an entire longitudinal length of said central shaft, said shaft having a plurality of equidistantly spaced apertures formed along a linear path traveling parallel to the longitudinal length;

a base having a plurality of coextensively shaped legs equidistantly spaced apart and radially extending outward from a bottom end of said central shaft, said base being monolithically formed with said central shaft such that said central shaft and said base can be readily transported as a single unit;

an elongated and non-linear boom spaced above said central shaft, said non-linear boom having an eyelet directly mated to a proximal end of said non-linear boom, wherein said proximal end of said non-linear boom is linearly offset from a distal end of said non-linear boom in such a manner that said proximal end of said non-linear boom is oriented along a horizontal plane when said distal end of said non-linear boom is disposed along an inclined plane;

a support bracket having a linear bottom arm telescopically engaged directly with said central shaft such that linear bottom arm is slidably positional along a vertical path registered parallel to the longitudinal length of said central shaft, said support bracket further including a hollow tubular top sleeve adjustably connected directly to said linear bottom arm;

means for automatically returning said non-linear boom to an equilibrium height after said non-linear boom is biased to a non-equilibrium height; and a cord tethered to said eyelet of said non-linear boom, said cord including a fastener attached to a bottom end thereof for temporarily holding a tennis ball at a predetermined height above a ground surface, wherein said tethered cord is spaced proximal to said automatic returning means.

14. The apparatus of claim 13, wherein said non-linear boom is slidably interfitted through said top sleeve such that said proximal end of said non-linear boom protrudes outwardly and beyond said base for providing a sufficient area to swing a racket without contacting said central shaft.

15. The apparatus of claim 13, wherein said non-linear boom and said top sleeve are resiliently rotatable about said linear bottom arm of said support bracket such that a positioned of said proximal end is adjustable between varying heights.

16. The apparatus of claim 13, further comprising: a latch pivotally connected to said non-linear boom, said latch having a hooked bottom lip for allowing a user to quickly and manually pivot said non-linear boom to a lowered position when attached a new tennis ball to said fastener of said tethered cord.

17. The apparatus of claim 13, wherein said automatic returning means comprises:

a helical spring member resiliently adaptable between expanded and retracted positions defined along an arcuate path offset from a vertical axis and a horizontal axis respectively; and a pair of eyelets directly conjoined to a distal end of said non-linear boom and a top end of said central shaft;

wherein said helical spring member has opposed ends directly coupled to said eyelets respectively, said helical spring member being oppositely situated from said tethered cord for providing adequate torque during rebound.

18. The apparatus of claim 13, wherein said fastener comprises: a hook and loop fastener.

* * * * *